343-700 MS AU 256 EX
9/1/81 OR 4,287,518

United States Patent [19]

Ellis, Jr.

[11] 4,287,518

[45] Sep. 1, 1981

[54] CAVITY-BACKED, MICRO-STRIP DIPOLE ANTENNA ARRAY

[76] Inventor: Robert A. Frosch, Administrator of the National Aeronautics and Space Administration, with respect to an invention of Haynes Ellis, Jr., Chino, Calif.

[21] Appl. No.: 145,206

[22] Filed: Apr. 30, 1980

[51] Int. Cl.[3] ..... H01Q 1/38

[52] U.S. Cl. ..... 343/700 MS; 343/708; 343/795; 343/846; 343/727

[58] Field of Search ..... 343/700 MS, 797, 789, 343/767, 795, 846, 708, 792, 727

[56] References Cited

U.S. PATENT DOCUMENTS

| | | | |
|---|---|---|---|
| 3,740,754 | 6/1973 | Epis | 343/797 |
| 3,789,416 | 1/1974 | Kuecken | 343/792 |
| 3,836,976 | 9/1974 | Monser et al. | 343/795 |
| 4,001,834 | 1/1977 | Smith | 343/795 |
| 4,012,741 | 3/1977 | Johnson | 343/700 MS |
| 4,067,016 | 1/1978 | Kaloi | 343/700 MS |
| 4,072,951 | 2/1978 | Kaloi | 343/700 MS |
| 4,072,952 | 2/1978 | Demko | 343/700 MS |
| 4,132,995 | 1/1979 | Monser | 343/767 |
| 4,155,089 | 5/1979 | Kaloi | 343/700 MS |
| 4,218,685 | 8/1980 | Ellis, Jr. | 343/727 |

*Primary Examiner*—David K. Moore
*Attorney, Agent, or Firm*—Russell E. Schlorff; John R. Manning; Marvin F. Matthews

[57] ABSTRACT

A flush-mounted antenna assembly (10) including a generally rectangular, conductive, box structure (11) open along one face to form a cavity. Within the cavity a pair of mutually orthogonal dielectric plane surfaces (13) (14) in an "egg crate" arrangement are mounted normal to the plane of the open face, each diagonally within the cavity. Each dielectric plane supports a pair of printed circuit dipoles typically (16) each fed from the opposite side of the dielectric plane by a printed "cone-shaped" feed line trace (15) which also serves as an impedance matching device (19) and functions as a balun connected from an unbalanced strip line external feed (24 and 26).

The open face of the conductive cavity can be flush mounted with a randome thereover, the assembly thereby being flush with the skin of a aircraft or space vehicle.

12 Claims, 5 Drawing Figures

CAVITY-BACKED, MICRO-STRIP DIPOLE ANTENNA ARRAY

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; U.S.C. 2457).

DESCRIPTION

TECHNICAL FIELD

My invention relates generally to antennas and more specifically to aircraft and space vehicle, flush-mounted, microwave band antennas.

In high performance aircraft and reentry space craft, air friction at high vehicle speeds results in heating to such an extent that any protrusions from the skin of the vehicle could be subject to damage or even burn-off. Accordingly, it is usually imperative that antenna structures not project beyond the skin surface of such a high performance air/space vehicle. Hence, it has been the practice to provide flush-mounted structures. The frequencies normally employed are very high including microwave region, and accordingly relatively compact structures are possible, even where special radiation patterns are required.

BACKGROUND ART

In the prior art, various approaches have been taken for the implementation of flush antenna structures. Various cavity enclosed antenna structures are extant in the prior art and any of these could be considered relevant to flush mounted air/spacecraft antennas, whether or not this prior art was developed for air/spacecraft employment.

Typical of the prior art cavity-type antennas are the devices shown in U.S. Pat. Nos. 3,836,976; 3,740,754 and 3,789,416. In U.S. Pat. No. 3,740,754, a turnstile antenna within a cup-like cavity is disclosed. The turnstile elements are bars or tubes self-supported from a central feed structure. It could be said that a radome might be affixed over the open cup and the device thereby converted to a flush mounted antenna by installing it in a corresponding opening in the skin of an air/space vehicle. The radiating elements of U.S. Pat. No. 3,740,754 would be unsuitable for the severe environment of air/space vehicle service, since in addition to air friction heating, shock and vibration are encountered. The discrete tubular or rod-like elements of that reference are likely to be unable to resist such shock and vibration and therefore its structure would be generally unsuitable for the application.

In U.S. Pat. No. 3,789,416, another turnstile antenna structure is shown mounted within a cup-like housing similar to the configuration of U.S. Pat. No. 3,740,754 in that its elements are mounted from a central feed. This device of U.S. Pat. No. 3,789,416 would be no more able to perform satisfactorily in the air/space vehicle application than would the apparatus of U.S. Pat. No. 3,740,754. Still further, both of these prior art devices would be relatively expensive to manufacture. Many metal forming steps and jig assembly appear necessary for either.

Concerning the so-called turnstile antenna configuration, it should be noted that this is a well-known concept in this art. It basically involves dipoles or colinear pluralities of dipoles in two orthogonal arrangements. Separate feeds permit separate excitation control and phasing for radiation pattern selection or polarization diversity or agility.

In U.S. Pat. No. 4,132,995, a cavity backed, slot-radiator antenna with an orthogonal, printed-circuit, feed strip is disclosed. While this disclosure shows the use of a printed circuit strip as a feed element, the actual radiator is a slot in a conductive sheet on the opposite side of the planar substrate sheet vis-a-vis the said feed element, facing into the cavity on one side and through the dielectric substrate and a radome sheet into the antenna aperture on the other side. No "turnstile" combination is provided by U.S. Pat. No. 4,132,995 and the radiation pattern is roughly a fixed cardiod.

Considering the use of the device of U.S. Pat. No. 4,132,995 as a flush antenna for very high speed, air/space, reentry type vehicles it becomes immediately apparent that the flat plane of the microstrip feed element would be separated from the high vehicle skin temperature induced by atmospheric reentry by only the relatively thin randome cover.

Other prior art is extant describing shaped, printed circuit dipoles and other printed radiators and the materials and processes for applying such printed circuit elements on a dielectric substrate, as for example by photolithography or selective etching, are now well understood by those of skill in this art.

Examples of microstrip (printed circuit) dipole and other radiators on dielectric substrates are disclosed in U.S. Pat. Nos. 4,012,741; 4,067,016; 4,072,951 and 4,155,089.

DISCLOSURE OF THE INVENTION

In consideration of the state of the prior art and the limitations thereof, it may be said to have been the general object of the invention to provide a flush, cavity-backed microstrip antenna of low cost construction in which the planes of the microstrip elements are orthogonal vis-a-vis the flush radome to reduce heating of the microstrips themselves. Moreover, it may be said to have been an object of the invention to provide aforementioned microstrip antenna elements in a turnstile configuration adapted to be fed through quadrature hybrids preceeded by a comparator hybrid having sum ($\Sigma$) and difference ($\Delta$) inputs, selection of one of these inputs resulting in a sum, single lobe pattern or a difference pattern in the form of two lobes separated by an angular null, respectively.

The microstrip dipoles and feeds are emplaced on interlocking diagonal ("egg-crate") dielectric planes (substrates) intersecting at right angles at the center of the square cavity cross-section. Thus only the edges of the microstrip dipoles are adjacent to the radome and are therefore less subject to heating due to high speed air friction against the radome than would be the case if the planes of the microstrip dipoles were adjacent to the plane of the radome.

The details of the structure of the invention will be more fully described as this specification proceeds.

BEST MODE FOR CARRYING OUT THE INVENTION

Figure 1:
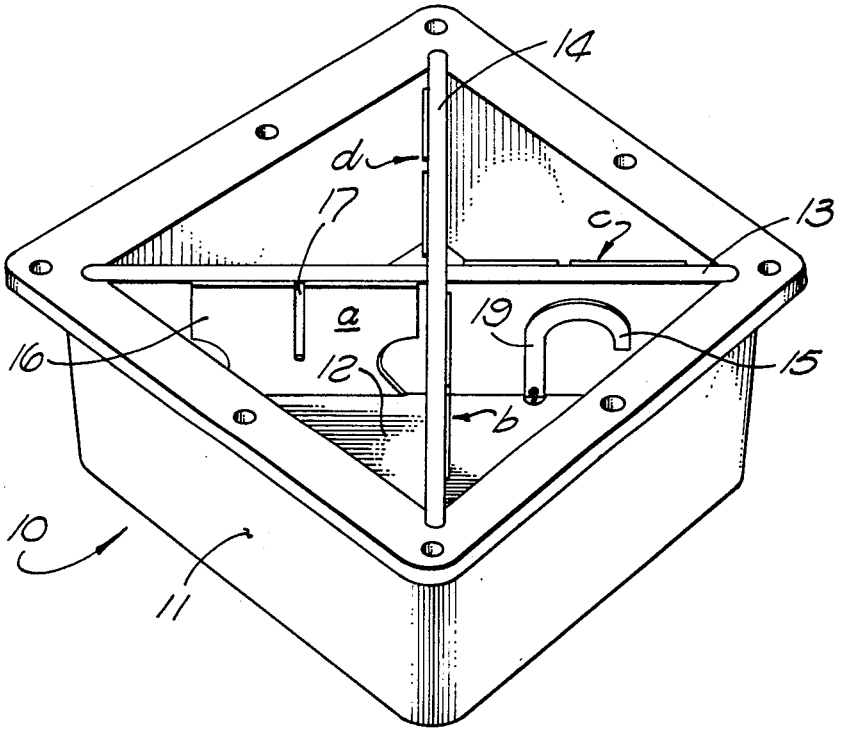
FIG. 1 is a perspective view of a typical antenna assembly according to the invention.

Referring now to FIG. 1, the antenna according to the invention instrumented in turnstile fashion is shown. The cavity is formed by a box structure 11 of conductive material. The flange of box 11 would be normally nearly flush with the mounting surface, for example the skin of an air/space vehicle. A radome (not shown) would normally close the open face of the cavity box, which is basically the aperture of the antenna, to provide a window substantially transparent to electromagnetic energy and also effecting aerodynamic surface continuity.

The rectangular conductive cavity box 11 is preferably one quarter wavelength deep at "in-guide" dimensions, i.e. 15% ± larger than a quarter wavelength in free space, and approximately three-quarter wavelength on a side internally. In that connection, these and other similar dimensions are expressed at the center of the design frequency band, although it is noted that no highly critical dimensional requirements apply to the described apparatus.

The cavity box 11 interacts with the active elements yet to be described in a manner comparable to that of other cavity antenna arrangements. The effect of installation of a basic antenna element in a conductive cavity has been studied and analyzed in the technical literature since basic forms of cavity antennas per se are known. One of the prior art U.S. patents referred to hereinbefore, namely U.S. Pat. No. 4,132,995, is a cavity-backed antenna and is subject to those general considerations.

Two substrates 13 and 14, typically of a nominal 1/16 inch (0.15 to 0.16 cm) thick dielectric material having a dielectric constant on the order of 2.5 are interlocked in "egg crate" fashion. Looking ahead to FIG. 2, this interlock at the cavity center will be appreciated. The slot 18 in 13 or 14 engages and overlaps the other substrate, and of course, it will be realized that only one of the substrates 13 and 14 has slot 18 as depicted in FIG. 2, the other substrate being similarly sloted but from its opposite edge.

Since the two substrates 13 and 14 are diagonals of cavity box 11, they are $\sqrt{2}$ S in length, where S is the cavity box side dimensions. It will be realized from FIG. 1 that four shaped dipoles 16 are employed in the total configuration, two on each of the substrates 13 and 14, each of these dipoles being backed on the opposite side of the substrate at the corresponding location such that feed symmetry is achieved. This will be explained more fully with reference to FIG. 2. The four dipoles are in substantially colinear pairs as will be seen in FIG. 1, the four dipoles being identified by letters a, b, c and d, those references being carried through to FIG. 3 to explain operation.

Figure 2:
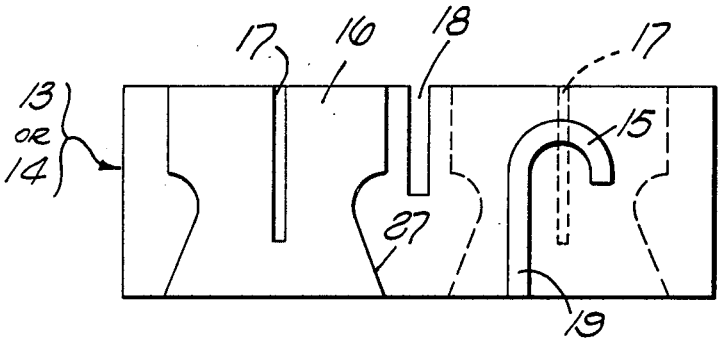
FIG. 2 is a view of one of the two substrates with printed circuit dipole and feed.

Referring now to FIG. 2, the "T" shaped dipole 16 is typical of all four dipoles. These and the feeds, comprising matching section 19 and coupling section 15 are applied by conventional printed circuit techniques. The shape of these dipoles is selected for broad-banding and in consideration of the impedance matching considerations within the cavity. Each of the dipoles, such as 16, has a slot 17 extending into (and through) the printed circuit of the shaped dipole 16 so as to divide the "T" head of the dipole into two dipole halves. The "base" of each dipole stem 27 is flared into forming symmetrical skirts which form an angle of approximately 45° with respect to each other. The total width of the "T" head is about one third wavelength, the vertical direction depth (FIG. 1) of the "T" head as viewed in FIG. 1 and the cavity association producing electrical equivalance to a quarter wave. The slot 17 for each dipole is slightly below the length corresponding to resonance at band center. That is, slot 17 would be less than one quarter wavelength in free space.

It will be realized that the width of the dipoles is substantially less than the diagonal of the cavity box; accordingly, a substantial portion of the length of each of the substrates near the cavity box corners is free of printed circuit elements and provides a mechanical support function only. The dipoles will be placed close to the slot 18 laterally, although actual dimensions are not critical in this regard.

From FIG. 2, it will be realized that each dipole is symmetrically fed by a feed trace comprising impedance matching section 19 and a curved trace 15. The curved trace 15 is preferably an approximate semicircle with its center of curvature opposite slot 17 on the opposite side of the microstrip board (substrate) which mounts them both. The coupling effected between each feed and its corresponding dipole is achieved in this manner. The radius of curvature of the feed is not critical, however the larger it is, the higher the impedance presented will be. The relationships observable from the drawings is typical in that regard. The feed trace comprising 19 and 15, in addition to its impedance matching function, operates as a balun providing a balanced dipole excitation from a basically unbalanced transmission line.

Figure 4:
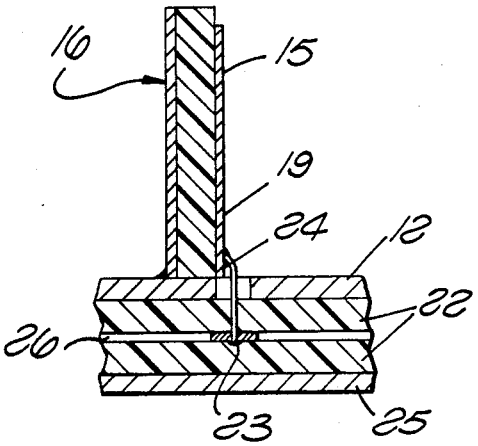
FIG. 4 is a detail of a typical feed connection from an associated stripline to to the feeds of the apparatus of FIG. 1.

Considering FIG. 4, next, the sectional view presented is somewhat exagerated for clarity. The dipole 16 and feed traces 19 and 15 are shown on opposite planes of dielectric board 13 or 14. A short connection 24 through an opening in the cavity floor 12 serves to connect each of the feed traces to the center conductor 26, dielectric 12 and a second ground plane 25 (12 being the first ground plane). The shaped dipole will be seen to be conductively fixed to the cavity box floor 12 at the base of its stem portion 27.

Figure 3:
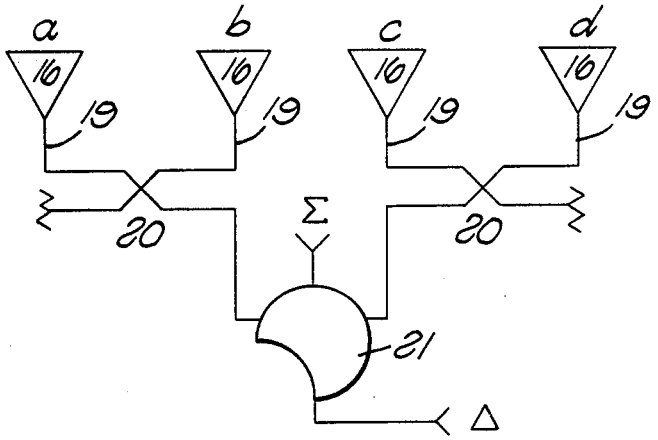
FIG. 3 is a schematic block diagram of a typical circuit configuration for employment of the antenna of the invention.

Referring now to FIG. 3, a typical utilization circuit for the antenna of the invention is shown. It may be assumed that individual feed transmission lines of the type described hereinbefore may be employed to produce an arrangement according to FIG. 3. Here the dipoles a and b, are coupled into ports of a first quadrature hybrid and dipoles c and d are similarly coupled into ports of a second quadrature hybrid. Those hybrids are four port devices, one of the remaining two ports of each being the output, assuming a receiving mode, and the fourth port being resistively terminated. These output ports connect discretely to a four port comparator hybrid 21, the other ports of which provide sum (Σ) and difference (Δ) outputs discretely.

Figure 5:
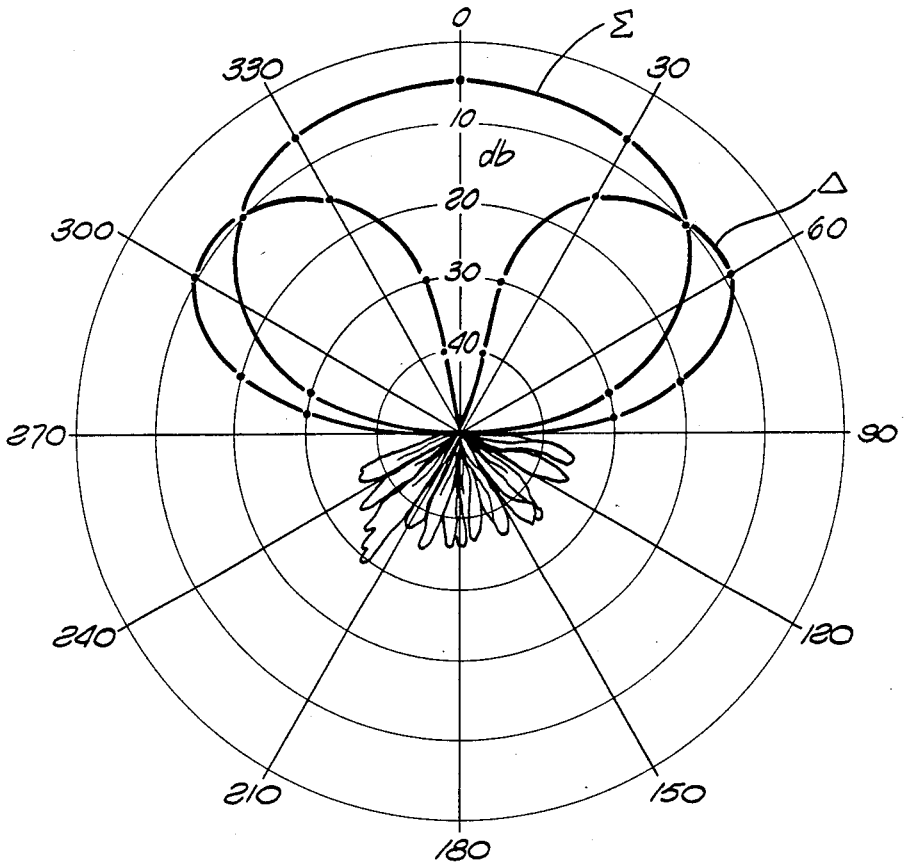
FIG. 5 is a typical radiation pattern for the configuration of FIG. 1, connected as indicated in FIG. 3, for alternate Σ and Δ ports excitation.

The apparatus described is, of course, fully reciprocal and for production of transmitting radiation patterns selectively as shown in FIG. 5, either the Σ or Δ input of comparator hybrid 21 would be excited. In the receiving mode, signals received according to one of these patterns are presented on the corresponding port (Σ or Δ) of hybrid 21.

It will also be realized by those of skill in this art that the antenna of the invention operated in the circuit configuration of FIG. 3 provides circular polarization. The "egg-crate" configuration of the printed element boards provides and maintains the orthogonality required for this circular polarization.

It will occur to those of skill in this art that other excitation configurations are possible to obtain other results comparable to the characteristics of which the basic turnstile antenna configuration is capable. Moreover, other modifications and variations will suggest themselves to those of skill in this art and accordingly, it is not intended that the invention should be regarded as limited in scope to the specific embodiment shown and described. The drawings and this description are intended to by typical and illustrative only.

We claim:

1. An antenna system particularly adapted for mounting flush with the skin surface of a reentrant air/space vehicle, to generate selectable sum and difference, circularly polarized radiation patterns from an aperture substantially flush with said skin surface comprising: a conductive cavity of substantially square cross-section in a plane parallel to said skin surface and of uniform depth internal to said vehicle, said cavity providing an aperture substantially at said flush mounting at said skin surface; first means within said cavity comprising a pair of dielectric boards each in a plane normal to said cavity cross-sectional plane, said boards each fitting between opposite corners of said cavity and intersecting orthogonally substantially at the center of said cavity; second means comprising a plurality of printed circuit dipoles, located two to the broad surface of each of said boards, one on either side of said board intersection; third means comprising a printed circuit feed trace on the opposite side of said dielectric board from each said dipoles, said traces each feeding a corresponding dipole through said board dielectric; fourth means comprising an external connection for each of said feeds to facilitate independent excitation control for each of said dipoles; and fifth means comprising a first four-port hybrid connected from two orthogonally adjacent dipole feeds of said third means to provide a first combined signal, a second four-port hybrid connected from the two remaining dipole feeds of said third means to produce a second combined signal, and a four-port comparator hybrid connected discretely at two of its ports to said first and second combined signals, said comparator hybrid also having Σ and Δ ports such that selective excitation of one of said Σ and Δ ports produces a corresponding antenna pattern.

2. Apparatus according to claim 1 in which said printed dipoles are "T" shaped with the "T" heads adjacent said aperture, said "T" shapes having flared stems extending to conductively join the bottom surface of said cavity, said "T" shapes being formed into dipoles by a non-resonant slot in each, running from said aperture to a predetermined depth less than the depth of said cavity, and said feed traces each comprise a connecting trace running from a connection opening in said cavity bottom to an open loop of substantially 180° curvature with its center of curvature opposite said slot of the corresponding printed circuit dipole, said feed traces each thereby acting as a balun to symmetrically couple to the corresponding dipole.

3. Antenna assembly particularly adapted for mounting flush with the skin surface of an air/space vehicle, comprising: a generally rectangular conductive cavity of square cross-section in a plane generally parallel to said skin surface at the location of said cavity, the aperture of said cavity being substantially flush with said skin surface; first means within said cavity comprising a pair of dielectric boards each in a plane normal to said cavity cross-sectional plane, said boards each fitting between opposite corners of said cavity and intersecting orthogonally substantially at the center of said cavity; second means comprising a plurality of printed circuit dipoles, located two to the broad surface of each of said boards one on either side of said board intersection; third means comprising a printed circuit feed trace on the opposite side of said dielectric board from each said dipoles, said traces each feeding a corresponding dipole through said board dielectric without conductive connection; and fourth means comprising an external connection for each of said feeds to facilitate independent excitation control for each said dipoles.

4. Apparatus according to claim 3 in which said printed dipoles are in the general shape of a "T" with the top of the head of said "T" continuous with the plane of said cavity aperture, the stem of said "T" being flared toward its base.

5. Apparatus according to claim 4 in which each of said dipoles are formed in two halves by a slot symmetrically placed in the printed circuit material of each of said "T" heads, said slots extending from said top of said "T" heads toward said stem base normal to said cavity aperture plane.

6. Apparatus according to claim 5 in which said slots are sub-resonant at the mid-band design frequency.

7. Apparatus according to claim 6 in which said slots are less than one-quarter wavelength long.

8. Apparatus according to claim 4 in which said "T" shaped dipoles and the depth of said cavity are both one quarter wavelength in-guide corresponding to approximately 1.15 of the free space quarter wavelength.

9. Apparatus according to claim 3 in which said third means feed traces each comprise a trace substantially parallel to said dipole slots and a curved open loop portion making substantially a 180° turn in the plane of said feed trace, said curved loop portion having its center of curvature opposite the slot of the corresponding dipole to provide a balanced feed for said corresponding dipole.

10. Apparatus according to claim 4 in which said "T" shaped dipole stem skirts make an angle of approximately 45° with respect to each other in the plane of said printed circuit dipole.

11. Apparatus according to claim 5 in which said "T" shaped dipole stem skirts make an angle of approximately 45° with respect to each other in the plane of said printed circuit dipole.

12. Apparatus according to claim 8 in which said third means feed traces each comprise a trace substantially parallel to said dipole slots and a curved open loop portion of said feed trace, said curved loop portion having its center of curvature opposite the slot of the corresponding dipole to provide a balanced feed for said corresponding dipole.

* * * * *